US008032059B2

(12) United States Patent
Klenkler et al.

(10) Patent No.: US 8,032,059 B2
(45) Date of Patent: Oct. 4, 2011

(54) APPARATUS AND METHODS FOR SUPPRESSING PHOTORECEPTOR IMAGE GHOST

(75) Inventors: Richard Klenkler, Oakville (CA); Ah-Mee Hor, Mississauga (CA); Vladislav Skorokhod, Mississauga (CA); Johann Junginger, Toronto (CA)

(73) Assignee: Xerox Corporation, Norwalk, CT (US)

( * ) Notice: Subject to any disclaimer, the term of this patent is extended or adjusted under 35 U.S.C. 154(b) by 336 days.

(21) Appl. No.: 12/395,534

(22) Filed: Feb. 27, 2009

(65) Prior Publication Data

US 2010/0221044 A1 Sep. 2, 2010

(51) Int. Cl.
*G03G 15/02* (2006.01)

(52) U.S. Cl. ..... 399/171

(58) Field of Classification Search ..... 399/38, 399/50, 107, 115, 168, 170–173
See application file for complete search history.

(56) References Cited

U.S. PATENT DOCUMENTS

| | | | | |
|---|---|---|---|---|
| 2,836,725 | A | 5/1958 | Vyverberg | |
| 4,086,650 | A | 4/1978 | Davis et al. | |
| 5,600,430 | A * | 2/1997 | Folkins et al. | 399/171 |
| 6,167,224 | A * | 12/2000 | Dalal | 399/222 |
| 7,424,250 | B2 * | 9/2008 | Markovics et al. | 399/128 |
| 7,904,012 | B2 * | 3/2011 | Kobashi et al. | 399/343 |

* cited by examiner

*Primary Examiner* — Hoan Tran
(74) *Attorney, Agent, or Firm* — Pillsbury Winthrop Shaw Pittman LLP

(57) ABSTRACT

The presently disclosed embodiments are directed to charging devices which produce a negative corona. The present embodiments pertain to the use of a positive charging device, such as a scorotron, after the erase lamp and before negative charging station in the xerographic cyclic to mitigate the undesirable changes in charge transport layer electrical properties that result from exposure to corona while negatively charging the photoreceptor during latent image formation.

20 Claims, 3 Drawing Sheets

APPARATUS AND METHODS FOR SUPPRESSING PHOTORECEPTOR IMAGE GHOST

BACKGROUND

The present embodiments relate generally to charging devices and in particular to charging devices which produce a negative corona. The present embodiments are directed to improved development systems and apparatuses that comprise a charging device that reduces print defects such as image ghosts and related methods. It is to be appreciated that the following embodiments may be used in both drum-based and belt-based xerographic printing systems.

In xerographic copiers and printing machines commonly used today, a photoconductive insulating member, namely, photoreceptor is usually charged to a negative potential, and thereafter exposed to a light image of an original document or laser exposure for digital documents, which are to be reproduced. The exposure discharges the photoconductive insulating surface in exposed or background areas to create an electrostatic latent image on the member which corresponds to the image areas contained within the original or digital document. Subsequently, the electrostatic latent image on the photoconductive insulating surface is made visible by developing the image with a developing powder referred to in the art as toner. During development the toner particles are attracted from the carrier particles by the charge pattern of the image areas on the photoconductive insulating area to form a powder or toned image on the photoconductive area. This image may be subsequently transferred to a support surface such as copy paper to which it may be permanently affixed by heating or by the application of pressure. Following transfer of the toner image to the support surface the photoconductive insulating surface may be discharged and cleaned of residual toner to prepare for the next imaging cycle.

Various types of charging devices have been used to charge or precharge photoconductive insulating layers. In commercial use, for example, are various types of corona generating devices to which a high voltage of 5000 to 8,000 volts may be applied to the corotron device thereby producing a corona spray which imparts electrostatic charge to the surface of the photoreceptor. One particular device takes the form of a single corona wire strung between insulating end blocks mounted on either end of a channel or shield.

A recently developed corona charged device is described in U.S. Pat. No. 4,086,650 to Davis et al., commonly referred to in the art as a dicorotron wherein the corona discharge electrode is coated with a relatively thick dielectric material such as glass so as to substantially prevent the flow of DC current there through. The delivery of charge to the photoconductive surface is accomplished by means of a displacement current or capacitive coupling through the dielectric material. The flow of charge to the surface to be charged is regulated by means of a DC bias applied to the corona bias shield. In operation an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In the dicorotron device described above the dielectric coated corona discharge electrode is a coated wire supported between insulating end blocks and the device has a conductive auxiliary DC electrode positioned opposite to the imaging surface on which the charge is to be placed. In the conventional corona discharge device, the conductive corona electrode is also in the form of an elongated wire connected to a corona generating power supply and supported by end blocks with the wire being partially surrounded by a conductive shield which is usually electrically grounded. The surface to be charged is spaced from the wire on the side opposite the shield and is mounted on a conductive substrate.

In addition to the desirability to negatively charge one type of photoreceptor, it often is desired to provide a negative precharge to another type photoreceptor such as selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically in such a precharge corotron an AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

Another device, which is frequently used to provide more uniform charging and to prevent overcharging, is a scorotron which can be comprised of one, or more corona wires or pin arrays with a conductive control grid or screen of parallel wires or apertures in a plate positioned between the corona wires and the photoconductor. A potential is applied to the control grid of the same polarity as the corona potential but with a much lower voltage, usually several hundred volts, which suppresses the electric field between the charge plate and the corona wires and markedly reduces the ion current flow to the photoreceptor.

Certain difficulties have been observed when using corona charge devices that produce a negative corona. One common problem is related to latent image ghost. The latent image ghost may occur when the print image has been changed from one job to another job. For instant, in the first print job, the copier or printer would print multiple copies of one image. In the next job, a new and different image would be printed. Unfortunately, the old image from the first job would often show up as some faint ghost image in the print copies of the new job. There have been various theories or speculations as to the root causes of the latent ghost image. One commonly held viewpoint is some undesirable charge trapping occurs in the photoreceptor preventing it to fully discharge to the pristine state that is completely devoid of latent image voltage from the first print job. Hence in the next print job, the trapped charges related to an old image are released and manifest as a print ghost in new print copies. In other cases, even changing the size of printing substrate or paper from one job to another can lead to some latent ghost image of paper edge. One reason is that the paper shields photoreceptor surface from the charging corona of transfer corotron that is typically used in assisting the transferring of toner from photoreceptor to paper. As a result, after multiple copies of printing, the area of photoreceptor not shielded by paper would experience some changes in electrical properties, such as charging and discharging behaviors that deviate from that of another area which has been shielded by the paper. In the next print job when a larger sheet of paper is used and it would span both areas of photoreceptor, the outline of former smaller paper would emerge as a paper edge ghost. In general, image ghosts degrade the print quality, and is unacceptable in many printing applications. One common way to prevent image ghost is using massive erase light to flood expose photoreceptor to remove trapped charges. Unfortunately, this traditional approach to suppressing image ghost has limited success. Furthermore, an extremely high dose of erase light can damage or fatigue photoreceptor due to photochemical reaction, resulting in more print defects and poorer charging property.

The development of latent image strongly depends on the electrical and photodischarge behavior of photoreceptor. In xerographic machines, such as laser printers, with a discharge area development (DAD) system, the photoreceptor surface is initially charged uniformly to certain negative voltage $V_H$ in darkness, and then exposed with imaging laser light to discharge the surface of photoreceptor to a lower voltage, namely, latent image voltage $V_L$. In principle, the area of photoreceptor which receives more exposed light will have a lower latent image voltage, which then will develop a darker image with toner. Two areas received the same amount of light should acquired the same latent image voltage $V_L$ and develop same density (lightness or grey levels) of toned image. However, complications arise due to some alteration of photoreceptor properties under the normal xerographic printing conditions, especially in a long print job of, says, several hundred or thousand copies of same image. Photoreceptor areas may be subjected to different stresses such as, light exposure, photodischarge, electrical charging, and other factors. The corona effluents generated from a negatively charge source is known to cause some change in electrical and photoelectrical properties of photoreceptors comprised of organic, and inorganic materials. Most commonly noticed effect is the charging, and photo-discharge behaviors. These undesirable changes are strongly suspected to cause print quality issues such as halftone image lightening, deletion, and corona related ghosting. The link between negative corona exposure and image quality issues in organic and inorganic photoreceptors has not been well understood. So far, the primary way to mitigate print quality issues related to corona has been to alter print engine settings. In severe cases, the only viable solution is to install a new photoreceptor to replace the fatigued one that image ghost can not be satisfactorily eliminated. This would increase component and service costs, and also reduce the productivity due to shutdown time of printer. No satisfactory solution has been identified that completely remedies the problem.

Thus, as the demand for improved print quality in xerographic reproduction is increasing, there is a continued need for achieving improved performance, such as finding a way to minimize or eliminate print defects in photoreceptors. A convenient, yet easy to implement solution is highly desirable for enhancing operation reliability of xerographic printers.

SUMMARY

According to aspects illustrated herein, there is provided a method for producing a toner image, comprising charging an imaging surface, further comprising charging the imaging surface with a positively charged scorotron, and subsequently charging the imaging surface with a negatively charged scorotron, exposing the imaging surface to an image to form an electrostatic latent image, forming a toner image with a toner-containing developer by developing the electrostatic latent image on the imaging surface, and transferring the toner image to a transfer substrate under a positive biased charging corotron, wherein no visible ghosts result in prints.

Another embodiment provides a method for developing a latent image on an imaging surface, comprising charging an imaging surface, further comprising charging the imaging surface with a positively charged scorotron, and subsequently charging the imaging surface with a negatively charged scorotron, wherein the positively charged scorotron charges the imaging surface with a positive charge equal to or slightly less than the absolute value of a negative charge with which the negatively charged scorotron charges the imaging surface, exposing the imaging surface to an image to form an electrostatic latent image, forming a toner image with a toner-containing developer by developing the electrostatic latent image on the imaging surface, and transferring the toner image to a transfer substrate under a positive biased charging corotron wherein no ghosting is observed in prints.

Yet another embodiment, there is provided an imaging apparatus for producing a toner image, comprising a charging unit for charging an imaging surface, the charging unit comprising a first scorotron for charging the imaging surface, wherein the first scorotron is positively charged, and a second scorotron for subsequently charging the imaging surface after the first scorotron, wherein the second scorotron is negatively charged, an exposing unit for exposing the imaging surface to an image to form an electrostatic latent image, a toner development unit for supplying a toner-containing developer to the exposed imaging surface, wherein the toner-containing developer forms a toner image by developing the electrostatic latent image on the imaging surface, and a transferring unit for transferring the toner image to a transfer substrate under a positive biased charging corotron, wherein no ghosting is observed in prints.

BRIEF DESCRIPTION OF THE DRAWINGS

For a better understanding, reference may be made to the accompanying figure.

DETAILED DESCRIPTION

In the following description, reference is made to the accompanying drawings, which form a part hereof and which illustrate several embodiments. It is understood that other embodiments may be used and structural and operational changes may be made without departure from the scope of the present disclosure.

The present embodiments pertain to the use of a positive charging device, such as a scorotron, after the erase lamp and before negative charging station in the xerographic cyclic. The additionally positive charging device functions to mitigate the undesirable changes in charge transport layer electrical properties that result from exposure to corona while negatively charging the photoreceptor during latent image formation.

Although positive corona is generally thought to degrade photoreceptors, the implementation has demonstrated unexpected results. For example, print quality defects, such as halftone image lightening, deletion, and corona related ghosting, caused by effluent from the negative charging corona is substantially reduced. The positive treatment is particularly useful with photoreceptors with organic materials as a transport layer. The organic photoreceptors are being designed for high mobility, high speed laser printer applications, and mobility is improved with this positive treatment.

Charge transport studies were performed to gain a deeper understanding of the underlying mechanism of how corona effluents affect the electrical properties of current generation photoreceptors. Hole charge mobility and photoinduced discharge measurements of charge transport layers and photoreceptors were compared before and after exposure to corona from a positive and/or negative charging device. It was found that exposure to corona effluents generated by a negative charging device dramatically reduced charge mobility and the photoreceptor's ability to discharge, which would lead to undesirable effects on print quality. In contrast, exposure to corona effluents generated by a positive charging device have no measurable effect on mobility. Additionally, it was found that the degree to which the electrical properties of a charge transport layer are altered (due to exposure to corona from a negative charging device) can be mitigated by interlacing the exposure to corona from a negative charging device with corona from a positive charging device during every print cycle. It is noted that cycling the photoreceptor for 500 negative cycles and then 500 positive cycles does not have the same mitigating effect as interlacing the negative and positive corona exposure on every cycle.

Figure 1:
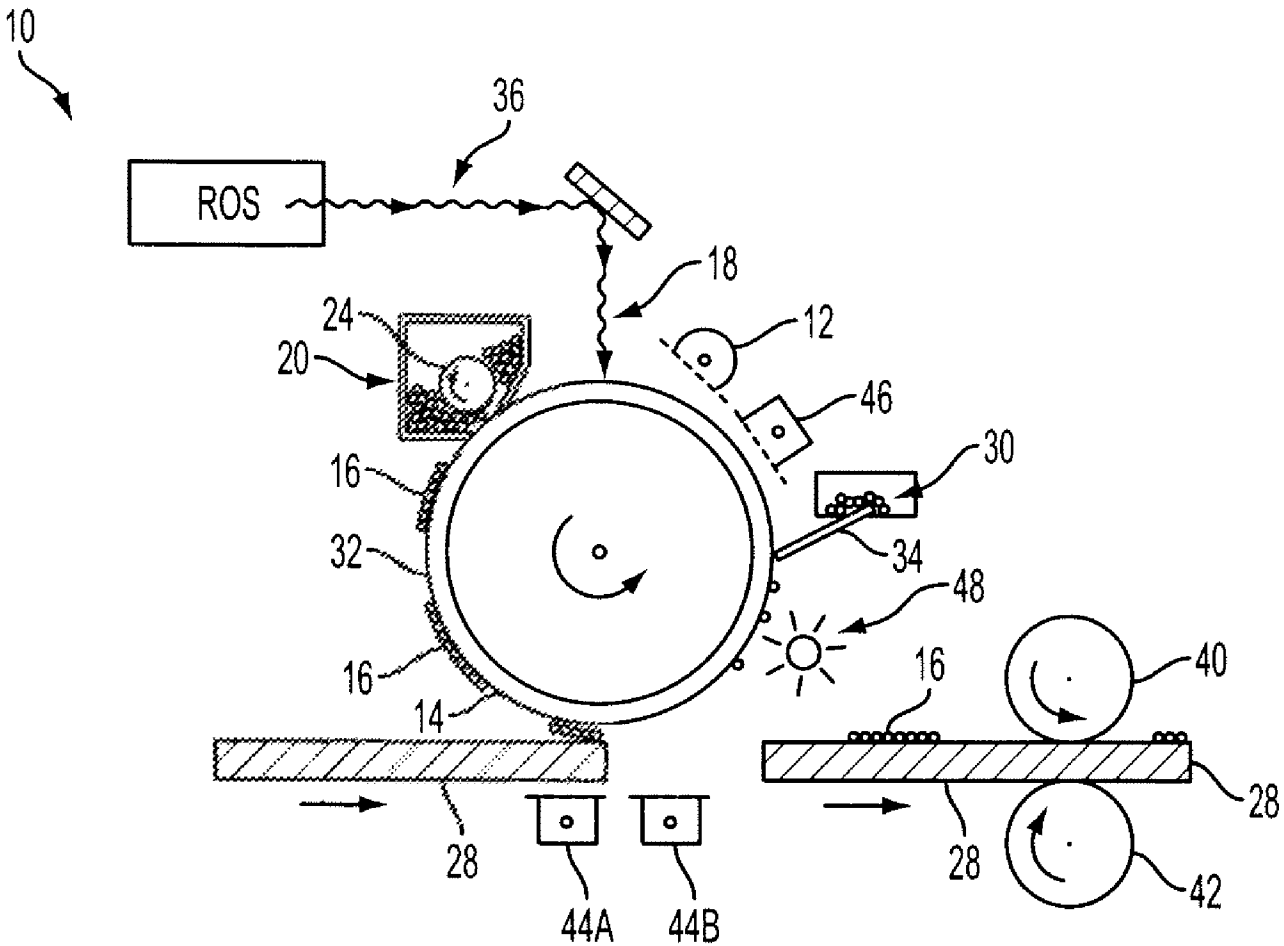
FIG. 1 is a schematic nonstructural view showing a development system of a printing machine according to the present embodiments.

In the present embodiments, the effect of the corona effluents is mitigated by positively charging the photoreceptor before it is charged negatively on every print cycles. Because of the undesirable effects caused by negative charging of the photoreceptor during latent image formation, the system or apparatus of the present embodiments adds a positively charged scorotron between the erase light and the negative scorotron marking the beginning of the latent image formation phase. An implementation of the system design in a drum type print engine is depicted in FIG. 1. However, the present embodiments may readily be used in a belt type engine as well.

In embodiments, there is provided a method for producing a toner image, comprising charging an imaging surface, further comprising charging the imaging surface with a positively charged scorotron, and subsequently charging the imaging surface with a negatively charged scorotron, exposing the imaging surface to an image to form an electrostatic latent image, forming a toner image with a toner-containing developer by developing the electrostatic latent image on the imaging surface, and transferring the toner image to a transfer substrate under a positive biased charging corotron, wherein no visible ghosts result in prints. The positively charged scorotron charges the imaging surface with a positive charge equal to or slightly less than the absolute value of a negative charge with which the negatively charged scorotron charges the imaging surface. In specific embodiments, the positively charged scorotron charges the imaging surface from about 50 V to about 1500 V, or from about +500 V to about +1000 V. In other embodiments, the negatively charged scorotron charges the imaging surface from about −50 V to about −1500 V, or from about −500 V to about −1000V. The exposing step further comprises illuminating the a charged portion of the imaging surface with a scanning laser beam modulated in accordance with an image signal input to form the electrostatic latent image. The method may further include cleaning residual toner from the imaging surface after the toner image is transferred to the transfer substrate. The method may also include erasing the imaging surface with flood exposure light before the positive scorotron charging.

In one embodiment, there is further provided an imaging apparatus for producing a toner image, comprising a charging unit for charging an imaging surface, the charging unit comprising a first scorotron for charging the imaging surface, wherein the first scorotron is positively charged, and a second scorotron for subsequently charging the imaging surface after the first scorotron, wherein the second scorotron is negatively charged, an exposing unit for exposing the imaging surface to an image to form an electrostatic latent image, a toner development unit for supplying a toner-containing developer to the exposed imaging surface, wherein the toner-containing developer forms a toner image by developing the electrostatic latent image on the imaging surface, and a transferring unit for transferring the toner image to a transfer substrate under a positive biased charging corotron, wherein no ghosting is observed in prints.

As shown in the FIG. 1, a xerographic copying device 10 may employ corona generating-devices, such as a scorotron. In the Figure, the xerographic copying device 10 has a negatively charged scorotron 12. The corona generating device or scorotron 12 serves to charge the photoreceptor 14 of a xerographic system in preparation of imaging. The photoreceptor 14 may comprise any suitable photoconductive material such as organic photoreceptors comprised of phthalocyanine/aryl amine, bisazo/hydrazone, perylene/arylamine, respectively, and may be in any suitable form such as drum, belt, web, etc. the photoreceptor 14 is moved in the direction shown by the solid line arrow by suitable drive means (not shown). In embodiments, the photoreceptor surface is comprised of organic polymeric composites containing charge transport materials, such as arylamine transport molecules dispersed in polymer binder, cross-linked organic polymer containing transport moieties, and mixtures thereof.

As known in the xerographic arts, xerographic systems of the type alluded to provide a series of xerographic processing stations about photoreceptor 14, the principal ones of which comprise a charge station where the photoreceptor 14 is uniformly charged by a negatively charged scorotron 12 in preparation for imaging, an exposure station 18 where the previously charged photoreceptor 14 is exposed to create a latent electrostatic copy image of the document or image being copied thereon, a developing station 20 where the latent electrostatic copy image is developed by a suitable toner contained in a toner hopper and applied with a developer roller, a transfer station where the developed image is transferred to a suitable copy substrate such as a copy sheet or paper 28, and a cleaning station 30 where the surface 32 of photoreceptor 14 is cleaned with a cleaning blade 34 and an erase station, such as an erase lamp, 48 to remove any leftover toner or other particles 16 preparatory to charging by the negatively charged scorotron 12. The cleaning station 30 may also employ one or more preclean scorotrons 44A, 44B, for example a positively charged scorotron, in association with the cleaning blade 34, to further neutralize the electrostatic forces which attract the residual toner particles to the photoreceptor surface 32 to remove any residual charge remaining thereon prior to the start of the next successive cycle. After the last transfer operation at transfer station, the copy sheet 28 having the developed image is transported in the direction of the arrow to fusing station where the transferred toner image is permanently fused to the copy sheet 28. The fusing station includes a heated fuser roll 40 and a pressure roll 42. The sheet passes through the nip defined by the fuser roll 40 and pressure roll 42. The toner image contacts fuser roll 40 so as to be affixed to the sheet. Thereafter, the copy sheet 28 is advanced to a catch tray (not shown) for subsequent removal by the machine operator.

Suitable optical means 36 are provided for focusing the document or image onto the photoreceptor 12 at the exposure station 18. It is understood that optical means may incorporate means to reduce the copy image size. In the embodiment shown, the optical means 36 is a scanning laser beam modulated in accordance with an image signal input.

Further shown in FIG. 1, an additional positively charged scorotron 46 is included within a conventional print engine. The positive charging device may be adjusted to charge the surface 32 of the photoreceptor 14 to any desired voltage, for example, form about 0 to about +800 V. Test results show that balancing the negative charge with an equal positive charge, or alternately, applying slightly less absolute positive charge than negative charge provide optimum results. The positively charged scorotron 46 is used due to its ability to more evenly charge the photoreceptor surface 32 than a corotron charging device.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

Example 1

Fixture Used to Measure Xerographic Electrical Properties of Photoreceptor and Create Latent Ghost Image A Xerox Corporation production photoreceptor was provided. This photoreceptor consisted of a Ti/Zr metallized mylar substrate as a ground plane, that was overcoated with a 50 weight percent HOGaPc pigment/50 weight percent poly (bisphenol-Z carbonate) photogenerating layer of ~0.5 um thickness, followed by an overcoating of a charge transporting layer of ~30 um thickness consisting of 50 weight percent N,N'-diphenyl-N,N-bis(3-methylphenyl)-1,1'-biphenyl-4,4'-diamine (TPD) transport molecule/50 weight percent MAKROLON 5705® polycarbonate resin.

Next, the sample device was mounted onto a drum. About 0.5 cm end area of photoreceptor (4 cm in width×16 cm in length) was first cleaned with dichloromethane to expose its metalized Ti/Zr ground plane. The member was then mounted on an aluminum drum (diameter: 84 mm) using conductive copper tape. The member was in electrically connected to the drum through the copper tape contacting the exposed ground plane Ti/Zr of member and a resistance of less than 1 k ohm was measured by a multimeter.

Figure 2:
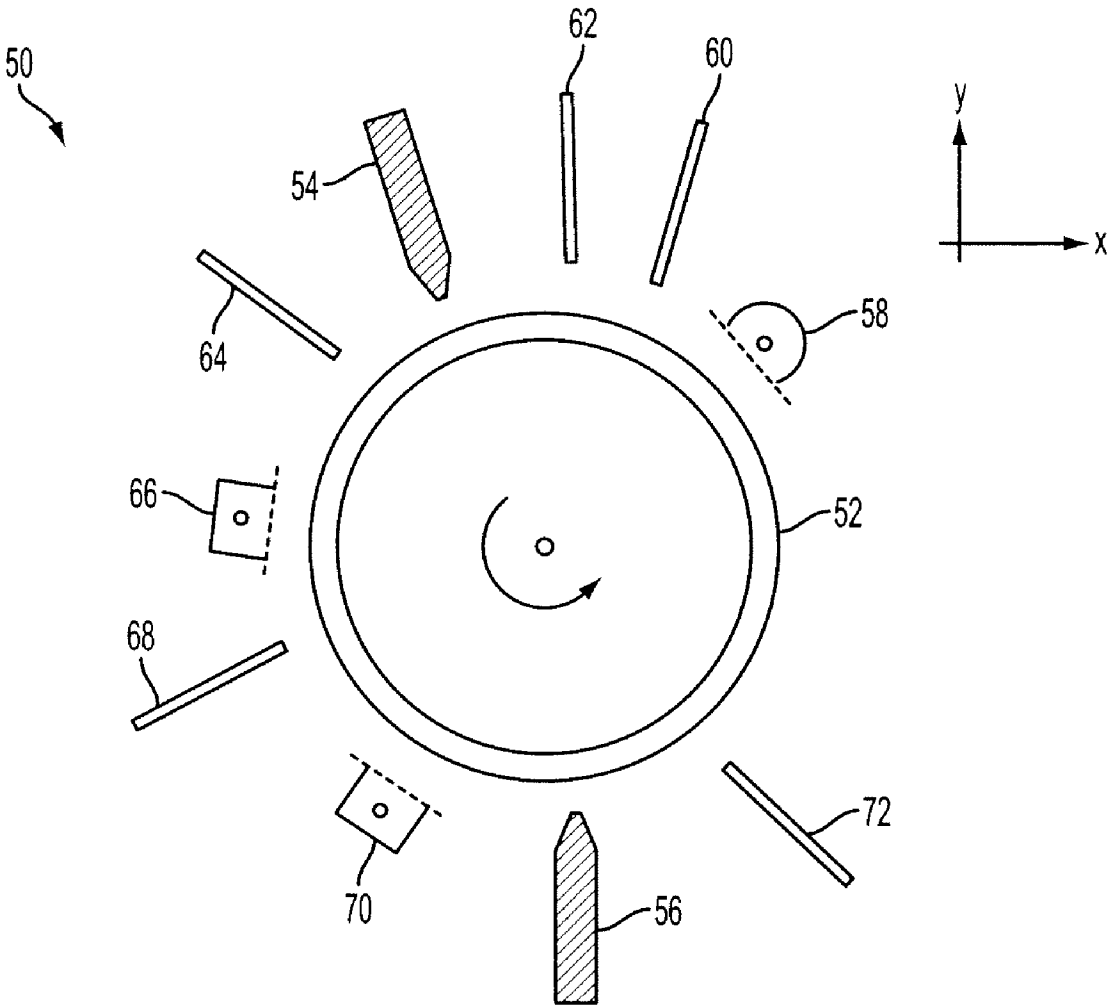
FIG. 2 is a xerographic scanner for conducting electrical measurement and ghosting experiments.

FIG. 2 shows the set-up of xerographic scanner 50 used in investigating electrical properties of photoreceptor and performing ghosting experiments. The xerographic scanner comprises a 'paperless-and-tonerless' fixture in which the cyclic photo-electrical performance of a photoreceptor is evaluated under controlled experimental conditions. The 84-mm drum carrying a photoreceptor 52, such as the one described above, is mounted about a central axis and automatically rotated about this axis at a controlled speed. In this work, a standard 90 RPM speed was adopted. Expose station 54 and optional erase station 56, charging scorotrons 58, 66, 70, and electrostatic voltmeters (ESV) 60, 62, 64, 68, 72 are situated at various angular positions around the drum. They are installed on a movable ring holder structure which is concentric with the drum axis. By simply shifting the ring holder to another location, we would be able to perform xerographic experiments on another section of the drum. The operation of xerographic scanner is controlled by a computer system. For example, the light intensity and spectrum (color) at the expose station can be adjusted and controlled automatically by the computer program. In a typical experiment, the exposure can be set to 780+/−5 nm using an optical filter and the optical energy per unit area can be continuously varied between 0 and 20 ergs/cm$^2$. For a broadband exposure, such as from a xenon arc lamp, the spectrum covers the range 400 nm to 950 nm, with a maximum optical energy density of 500 ergs/cm$^2$. The scorotrons and lights can individually be controlled by the xerographic scanner's computer program. Furthermore, the multiple samples mounted on the drum can be resolved and detected by the computer program. This allows for the each sample to be individually charged by the scorotron(s) and/or exposed to light by the light expose station(s). This level of control permits selectively exposure of the samples to different stresses from positive and negative corona sources, simulating differential stress conditions in a print-engine environment. In this example the xerographic scanner was setup to include a negative scorotron 58 at an angular position of 0 degrees, a first ESV 60 at 43 degrees, a second ESV 62 at 67 degrees, an expose station 54 at 90 degrees, a third ESV 64 at 138 degrees, a pulsed positive scorotron 66 at 182 degrees, a fourth ESV 68 at 225 degrees, a de-ghosting positive scorotron 70 at 260 degrees, an erase station 56 at 295 degrees, and a fifth ESV 72 at 320 degrees. The erase station may also be located before the de-ghosting positive scorotron.

Figure 3:
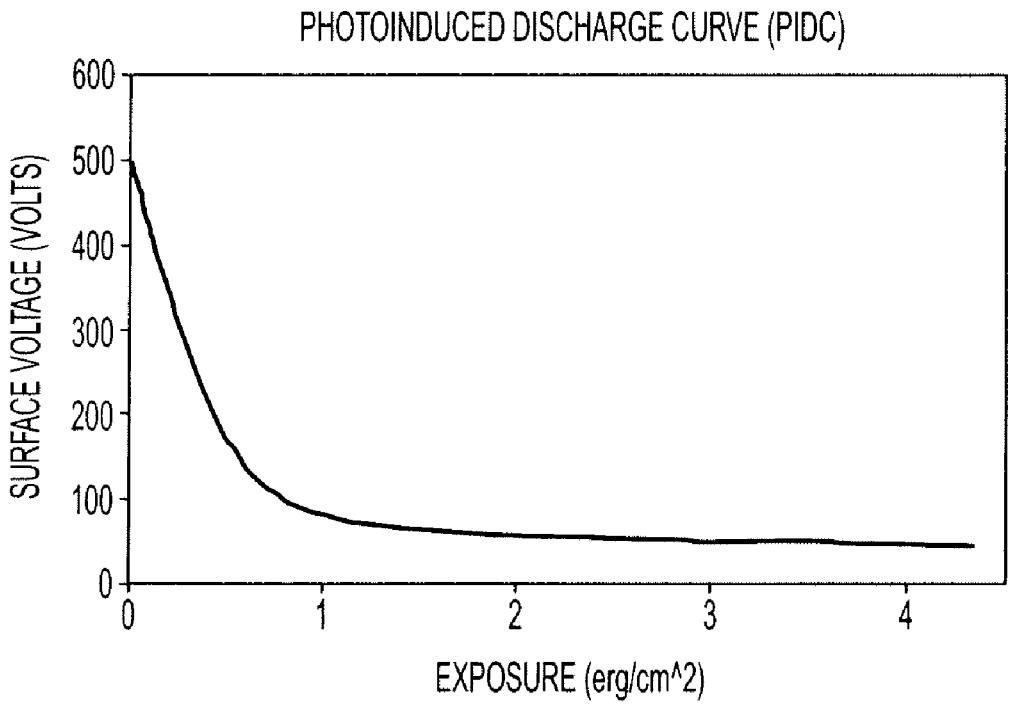
FIG. 3 is a graph illustrating the photoinduced discharge curve (PIDC) of an embodiment according to the present embodiments.

Photo-induced discharge (PIDC) measurements were taken using the xerographic drum scanner, before and after stress cycling. With the sample drum rotating at 90 RPM the PIDC measurements of photoreceptor were determined concurrently by charging the sample to a surface voltage $V_H$~−500 volts with the negative scorotron in the dark, illuminating samples with 780 nm light from the expose lamp at varying light intensity from 0 and 20 erg/cm$^2$, and measuring the surface voltage with electrostatic voltmeters shortly thereafter. The pulsed positive scorotron was off during the PIDC measurement, and the erase lamp was set to a broadband white light from a xenon-arc lamp at ~500 ergs/cm$^2$ (on the sample). Any location on photoreceptor could be measured by moving the ring holder in the z direction, i.e. along the axis of the drum on which the sample was mounted. The voltage after erase was measured with ESV5. The PIDC curve was collected by recording the post exposure voltage (V), measured with ESV3, as a function of EXP (erg/cm$^2$). A typical PIDC curve is shown in FIG. 3.

Example 2

Experiment to Form Latent Paper Edge Ghost

One type of stress encountered in a commercial print-engine environment is known as paper edge ghost, in which some areas of the photoreceptor are shielded by paper while the inter-document zone of the photoreceptor is directly exposed to a transfer positive charging corona. Also the inter-document zone is the area of photoreceptor not subjected to image-wise exposure by laser or imaging light. As the result, the photoreceptor area corresponding to the inter-document zone may experience a different electrical charging stress after a prolonged print job. In the next print job, if the paper size is changed to a larger size, this inter-document zone would be spanned by the new larger paper, and this may lead to a printing defect commonly known as a paper edge ghost which clearly shows the outline of smaller paper used in the previous print job.

One of the root causes of paper edge ghost arises because of the differential change in electrical properties of the imaging member. Typically, in the DAD system, the inter-document zone of photoreceptor experiences a lower image potential $V_L$ value after photodischarge, leading to the development of darker print density as compared to the surrounding area outside the inter-document zone.

In accordance with Example 1, a photoreceptor Sample A was mounted on the 84 mm drum. The paper edge ghost was simulated in the xerographic scanner by covering the middle portion of the pulsed positive scorotron grid with a strip of paper. The scorotron active area was 2.7 cm wide and the paper width covered ~1.3 cm of that. The paper was secured with adhesive tape to the side of the scorotron shield. The paper masked the scorotron emission locally. For convenience, the area of photoreceptor facing the paper mask was designated as the middle section, and the two adjacent areas not facing the mask were designated left and right sections. The negative scorotron was driven by a wire current of −150 μA with the grid held at a constant −600 V, giving total charging of ~−500 V on the sample. The pulsed positive scorotron was pulsed on and off to simulate the transfer corotron used in xerographic printer. The positive pulsed scorotron was driven by a pulsed wire current of +75 μA with the grid synchronously pulsed at +1000 V. The expose station was set to emit broadband white light, from a Xe arc-lamp source at ~500 erg/cm$^2$ onto the sample. The erase station was turned off during this cycling. To generate the paper edge ghost the sample was cycled under the above described conditions at a drum rotation speed of 90 RPM for 10 kilocycles. During cycling, all sections of photoreceptor Sample A were exposed to negative charging. Since the middle portion of the pulsed positive scorotron was masked by the paper, the middle portion of Sample A was therefore not exposed to positive charging. However, the adjacent left and right sections experienced additional positive charging. After that, the PIDC measurements were performed on each section of Sample A, i.e. the middle and two adjacent sections on the left and the right respectively. From the PIDC curves, the image voltages $V_L$ at various exposure energy levels were determined for each section and summarized in Table 2.

TABLE 2

Paper edge ghost experiment on Sample A: Image voltages $V_L$ of photoreceptor measured in various sections subjected to different charging conditions

| Exposure energy, erg/cm$^2$ | image voltage $V_L$, volts of left section negative charging pulsed positive charging not masked by paper | image voltage $V_L$, volts of middle section negative charging pulsed positive charging masked by paper | image voltage $V_L$, volts of right section negative charging pulsed positive charging not masked by paper | Difference in image voltage, volts (middle-left) sections, or, (middle-right) sections |
|---|---|---|---|---|
| 0.5 | 180 | 234 | 180 | 54 |
| 1.0 | 291 | 349 | 291 | 58 |

At various exposure energy levels, the middle section always showed significantly higher negative voltage values than the other two adjacent sections. At 0.5 erg, the difference was about 54 volts, and at 1.0 erg, it was about 58 volts. The differences in degree of positive and negative corona charging significantly altered the electrical properties of imaging member that the middle section had cycled up more to reach a higher $V_L$ than adjacent sections. In other words, the middle section had a lower photodischarge level. From xerographic development point of view, when the sample received uniform light exposure, the middle section would develop a substantially lighter image density due to its higher $V_L$ as compared to the other sections. This difference in electrical properties across Sample A would cause the paper edge ghost, which would manifest to show the outline of paper mask if subsequent prints are made with the imaging member.

Example 3

Experiment to Demonstrate the Effect of De-Ghosting Charger to Suppress Paper Edge Ghost In accordance with Example 2, a photoreceptor Sample B (each 4 cm×16 cm) mounted on an Al drum (diameter: 84 mm) using conductive copper tape. Similar to Example 2, the xerographic scanner was setup to simulate a paper edge ghost, except that an additional positive de-ghosting charger would be activated during cycling. The de-ghosting charger was driven at a constant wire current of +75.0 uA and a constant grid voltage of +1000 V. For the purpose of establishing an experimental control, the de-ghosting charger scorotron was offset from the pulsed positive scorotron in the z direction by between 0.7 cm and 1.0 cm to allow for a non-de-ghosting section, i.e. the left section of Sample B. The middle and right sections of Sample B were exposed to de-ghosting charging during cycling.

Therefore, the three sections of Sample B were subjected to different extent of charging. During cycling, all sections of photoreceptor Sample B were exposed to negative charging. Since only the middle portion of the pulsed positive scorotron was masked by the paper, the middle portion of Sample B was therefore not exposed to pulsed positive charging. The middle and right sections of Sample B were subjected to de-ghosting charging. After 10 kilocycles of stress cycling, the PIDC measurements were performed on each section of Sample B.

TABLE 3

De-ghosting Experiment on Sample B: Image voltages $V_L$ of photoreceptor measured in various sections under different charging conditions

| image voltage $V_L$, volts of left | image voltage $V_L$, volts of middle section negative charging pulsed | image voltage $V_L$, volts of right section negative | Difference in image voltage, volts (middle- |
|---|---|---|---|

| Exposure energy, erg/cm$^2$ | section negative charging pulsed positive charging | positive charging masked by paper de-ghosting charging | charging pulsed positive charging de-ghosting charging | left) sections or (middle-right) sections |
|---|---|---|---|---|
| 0.5 | 183 | 201 | 181 | ~19 |
| 1.0 | 296 | 321 | 298 | ~24 |

From the PIDC curves, the image voltages $V_L$ at various exposure energy levels were determined for each section and summarized in Table 3. At various exposure energy levels, the middle section always showed a higher negative voltage values than the other two adjacent sections. At 0.5 erg, the difference was about 19 volts, and at 1.0 erg, it was about 24 volts. Compared to the results in Table 2 obtained in Example 1—the experiment of paper edge ghost, the de-ghosting charging had significantly reduced the voltage differences between the middle section and adjacent sections from 54 volts to 19 volts at 0.5 erg exposure energy and from 58 volts to 24 volts at 1.0 erg exposure energy. Clearly, the de-ghosting charger had mitigated the effect of paper mask and the cycle-up of $V_L$ in the middle section was dramatically decreased. In xerographic development, the more equalized voltages across different sections would lead a more uniform print density across the Sample B and minimizing the manifestation of paper edge ghost.

Thus, the paper edge ghost in Example 2 was strongly mitigated by the addition of the de-ghosting charger.

Example 4

Halftone Print Test

After performing the PIDC measurements the degree to which the ghost could be resolved in a print was evaluated by a halftone print testing scheme. The aforementioned 84 mm Al drum onto which a 4 cm×16 cm strip of the above provided photoconductor member was mounted was then placed into a suitable drum housing. The cleaning blade was removed from the drum housing to prevent it from removing the mounted photoconducting member during operation. The drum and drum housing assembly was then placed in a Xerox Docu Color 12 machine and a template containing a halftone rectangle was printed. The machine settings (developer bias, laser power, and grid bias) were adjusted to obtain a visible print that resolved a halftone rectangle. The resulting prints from the imaging members (Samples A and B) from Examples 2 and 3 were measured and digitized using a commercial document scanner and the average grey level value was reported for each of the six aforementioned regions of interest. The results are presented in Tables 4 and 5 respectively. A higher grey level means a lighter half-tone print density.

TABLE 4

Halftone Print Test Results of Sample A (from Example 2 - Paper edge ghosting experiment)

| Grey level of left section image negative charging pulsed positive charging not masked by paper | Grey level of middle section image negative charging pulsed positive charging masked by paper | Grey level of right section image negative charging pulsed positive charging not masked by paper | Difference in grey level (middle-left) sections, or, (middle-right) sections |
|---|---|---|---|
| 117 | 136 | 117 | 19 |

TABLE 4-continued

Halftone Print Test Results of Sample A (from Example 2 - Paper edge ghosting experiment)

| Grey level of left section image negative charging pulsed positive charging not masked by paper | Grey level of middle section image negative charging pulsed positive charging masked by paper | Grey level of right section image negative charging pulsed positive charging not masked by paper | Difference in grey level (middle-left) sections, or, (middle-right) sections |
|---|---|---|---|

For Sample A after completing the paper edge ghosting experiment, the halftone printing results clearly indicated a big difference in grey level between the sections masked by paper and not masked by paper. The middle section appeared lighter than the adjacent sections, and paper edge showed up on the both sides of middle section. A difference of 19 units in grey level was obtained between the middle and adjacent sections hence this became very objectionable in high quality print. The grey scale level increased in the middle section of photoreceptor as it saw only negative corona charging and cycled up electrically to higher $V_L$ as measured in Example 2.

TABLE 5

Halftone Print Test Results of Sample B (Example 3 - De-ghosting experiment)

| Grey level of left section negative charging pulsed positive charging | Grey level of middle section negative charging pulsed positive charging masked by paper de-ghosting positive charging | Grey level of right section negative charging pulsed positive charging de-ghosting positive charging | Difference in Grey level (middle-left) sections or (middle-right) sections |
|---|---|---|---|
| 137 | 133 | 133 | 4 or less |

For Sample B after completing the de-ghosting experiment, the halftone printing results clearly indicated there was a small difference about 4 or less units in grey level between the sections masked by paper and not masked by paper, and a uniform print density was observed across the three sections. In other words, the paper edge ghost was greatly suppressed and virtually not observed. The additional de-ghosting positive charging was capable of returning the photoreceptor to electrically more uniform conditions even though the different sections of photoreceptor had undergone significantly different charging conditions.

The results show that halftone lightening caused by cycle up was mitigated when exposure to negative corona was interlaced with exposure positive corona in every cycle. Additionally, halftone lightening occurred in any section of the imaging member that was blocked from positive corona, such as in the middle section of photoreceptor where the positively charged scorotron was blocked by the paper strip.

The results show that halftone lightening was prevented over the section of the imaging member that was exposed to the de-ghosting charger regardless of the presence of the paper strip that blocked the pulsed positive scorotron. Thus, the paper edge ghost in Example 2 was strongly mitigated by an additional de-ghosting charger.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A method for producing a toner image, comprising:

charging an imaging surface, further comprising charging the imaging surface with a positively charged scorotron, and subsequently charging the imaging surface with a negatively charged scorotron;

exposing the imaging surface to an image to form an electrostatic latent image;

forming a toner image with a toner-containing developer by developing the electrostatic latent image on the imaging surface; and transferring the toner image to a transfer substrate under a positive biased charging corotron, wherein no visible ghosts result in prints.

2. The method of claim 1, wherein the positively charged scorotron charges the imaging surface with a positive charge equal to or slightly less than the absolute value of a negative charge with which the negatively charged scorotron charges the imaging surface.

3. The method of claim 1, wherein the positively charged scorotron charges the imaging surface from about 50 V to about 1500 V.

4. The method of claim 3, wherein the positively charged scorotron charges the imaging surface from about 500 V to about 1000 V.

5. The method of claim 1, wherein the negatively charged scorotron charges the imaging surface from about −50 V to about −1500 V.

6. The method of claim 5, wherein the negatively charged scorotron charges the imaging surface from about −500 V to about −1000 V.

7. The method of claim 1, wherein the exposing step further comprises illuminating the charged portion of the imaging surface with a scanning laser beam modulated in accordance with an image signal input to form the electrostatic latent image.

8. The method of claim 1 further including cleaning residual toner from the imaging surface after the toner image is transferred to the transfer substrate.

9. The method of claim 1 further including erasing the imaging surface with flood exposure light before the positive scorotron charging.

10. The method of claim 1, wherein the imaging surface comprises organic polymeric composites containing charge transport materials.

11. The method of claim 10, wherein the charge transport material is selected from the group consisting of arylamine transport molecules dispersed in polymer binder, cross-linked organic polymer containing transport moieties, and mixtures thereof.

12. A method for developing a latent image on an imaging surface, comprising:

charging an imaging surface, further comprising charging the imaging surface with a positively charged scorotron, and subsequently charging the imaging surface with a negatively charged scorotron, wherein the positively charged scorotron charges the imaging surface with a positive charge equal to or slightly less than the absolute value of a negative charge with which the negatively charged scorotron charges the imaging surface;

exposing the imaging surface to an image to form an electrostatic latent image;

forming a toner image with a toner-containing developer by developing the electrostatic latent image on the imaging surface; and transferring the toner image to a transfer substrate under a positive biased charging corotron wherein no ghosting is observed in prints.

13. An imaging apparatus for producing a toner image, comprising:

a charging unit for charging an imaging surface, the charging unit comprising a first scorotron for charging the imaging surface, wherein the first scorotron is positively charged, and a second scorotron for subsequently charging the imaging surface after the first scorotron, wherein the second scorotron is negatively charged;

an exposing unit for exposing the imaging surface to an image to form an electrostatic latent image;

a toner development unit for supplying a toner-containing developer to the exposed imaging surface, wherein the toner-containing developer forms a toner image by developing the electrostatic latent image on the imaging surface; and a transferring unit for transferring the toner image to a transfer substrate under a positive biased charging corotron, wherein no ghosting is observed in prints.

14. The image forming apparatus of claim 13 further including a cleaning unit for cleaning residual toner from the imaging surface after the toner image is transferred to the transfer substrate.

15. The image forming apparatus of claim 13 further including a flood exposure unit for erasing the imaging surface prior to the positive scorotron charging step.

16. The image forming apparatus of claim 13, wherein the positively charged scorotron charges the imaging surface from about 50 V to about 1500 V.

17. The image forming apparatus of claim 13, wherein the negatively charged scorotron charges the imaging surface from about −50 V to about −1500 V.

18. The image forming apparatus of claim 13, wherein the imaging surface comprises organic polymeric composites containing charge transport materials.

19. The image forming apparatus of claim 18, wherein the charge transport material is selected from the group consisting of arylamine transport molecules dispersed in polymer binder, cross-linked organic polymer containing transport moieties, and mixtures thereof.

20. The image forming apparatus of claim 13, wherein the positively charged scorotron charges the imaging surface with a positive charge equal to or slightly less than the absolute value of a negative charge with which the negatively charged scorotron charges the imaging surface.

* * * * *